US006675779B2

(12) United States Patent
King et al.

(10) Patent No.: US 6,675,779 B2
(45) Date of Patent: Jan. 13, 2004

(54) DUAL FLOAT VALVE FOR FUEL TANK VENT WITH LIQUID CARRYOVER FILTER

(75) Inventors: Timothy King, Connersville, IN (US); Darrin Hurley, Brownstown, MI (US)

(73) Assignee: Stant Manufacturing Inc., Connersville, IN (US)

( * ) Notice: Subject to any disclaimer, the term of this patent is extended or adjusted under 35 U.S.C. 154(b) by 0 days.

(21) Appl. No.: 10/170,603

(22) Filed: Jun. 13, 2002

(65) Prior Publication Data

US 2003/0230288 A1 Dec. 18, 2003

(51) Int. Cl.[7] ..... F02M 33/02
(52) U.S. Cl. ..... 123/519; 123/518
(58) Field of Search ..... 123/519, 520, 123/518; 137/588, 110, 39

(56) References Cited

U.S. PATENT DOCUMENTS

| | | | | |
|---|---|---|---|---|
| 4,790,349 | A | 12/1988 | Harris | 137/587 |
| 4,953,583 | A | 9/1990 | Szlaga | 137/118 |
| 4,966,189 | A | 10/1990 | Harris | 137/587 |
| 4,991,615 | A | 2/1991 | Szlaga et al. | 137/43 |
| 5,028,244 | A | 7/1991 | Szlaga | 55/170 |
| 5,065,782 | A | 11/1991 | Szlaga | 137/39 |
| 5,116,257 | A | 5/1992 | Szlaga | 137/43 |
| 5,156,178 | A | 10/1992 | Harris | 137/43 |
| 5,234,013 | A | 8/1993 | Roetker et al. | 137/43 |
| 5,234,022 | A | 8/1993 | Harris | 137/498 |
| 5,261,439 | A | 11/1993 | Harris | 137/43 |
| 5,318,069 | A | 6/1994 | Harris | 137/588 |
| 5,388,611 | A | 2/1995 | Harris | 137/588 |
| 5,443,561 | A | 8/1995 | Sakata et al. | 137/202 |
| 5,449,018 | A | 9/1995 | Harris | 137/493.9 |
| 5,449,029 | A | 9/1995 | Harris | 141/198 |
| 5,518,018 | A * | 5/1996 | Roetker | 137/43 |
| 5,535,772 | A | 7/1996 | Roetker et al. | 137/43 |
| 5,566,705 | A | 10/1996 | Harris | 137/43 |
| 5,687,778 | A | 11/1997 | Harris | 141/59 |
| 5,694,968 | A | 12/1997 | Devall et al. | 137/202 |
| 5,797,434 | A * | 8/1998 | Benjey et al. | 141/59 |
| 5,944,044 | A | 8/1999 | King et al. | 137/202 |
| 6,003,499 | A | 12/1999 | Devall et al. | 123/520 |
| 6,016,827 | A | 1/2000 | Dawson | 137/202 |
| 6,035,884 | A | 3/2000 | King et al. | 137/202 |
| 6,170,510 | B1 | 1/2001 | King et al. | 137/202 |
| 6,240,950 | B1 | 6/2001 | Harris | 137/202 |
| 6,311,675 | B2 | 11/2001 | Crary et al. | 123/516 |
| 6,405,747 | B1 | 6/2002 | King et al. | 137/202 |
| 6,422,261 | B1 | 7/2002 | DeCapua et al. | 137/202 |
| 6,431,200 | B2 | 8/2002 | Brock et al. | 137/202 |

* cited by examiner

*Primary Examiner*—Mahmoud Gimie
(74) *Attorney, Agent, or Firm*—Barnes & Thornburg

(57) ABSTRACT

A tank venting apparatus or a fill-limit and tank ventilation valve is disclosed for use with a fuel tank. The valve has a housing which contains a first valve assembly, second valve assembly, third valve assembly and fourth valve assembly. The first valve assembly primarily communicates with the fuel tank. The fourth valve assembly communicates with a vapor recover canister and a filler neck to the tank. The first valve assembly also communicates with the third valve assembly and the second valve assembly. The second valve assembly generally communicates with the first valve assembly and the third valve assembly. The third valve assembly communicates with the first valve assembly, second valve assembly and fourth valve assembly. The third valve assembly prevents passage of liquid fuel from the tank to the canister. The fourth valve assembly manages flow from the valve.

21 Claims, 14 Drawing Sheets

DUAL FLOAT VALVE FOR FUEL TANK VENT WITH LIQUID CARRYOVER FILTER

BACKGROUND

The present disclosure relates to an apparatus for controlling discharge of fuel vapor from a fuel tank. The fuel tank is the type which is used on motor vehicles. The present disclosure combines a control valve, liquid vapor separation and a flow management valve in a single housing. The apparatus includes a housing containing a first valve communicating with the fuel tank and a second valve which communicates with at least the first valve. A third valve communicates with the first valve and the second valve. A fourth valve communicates with the third valve and at least a vapor-recovery canister. The first valve controls discharge of pressurized fuel vapor from the tank during refueling. The second valve is a "run-loss" valve which operates to vent the fuel tank during vehicle operation. The third valve overlies portions of the first and second valves and blocks liquid fuel carryover from the tank to the vapor-recovery canister. The fourth valve provides flow management.

A variety of apparatus are available to control the escape of pressurized fuel vapor from a fuel tank during refueling. There is also a variety of apparatus which utilize a "run-loss" valve. These apparatus are part of a vapor recovery system used on many vehicles.

It is also desirable to provide a fuel tank which minimizes the space and volume requirements for mounting in a vehicle. Currently, many fuel tanks require a raised cavity therein for defining a "vapor bubble". This vapor bubble area is used in the automatic shut off systems employed in modem fuel systems. At the point at which the valve shuts off, a vapor back pressure is created causing the inlet check valve to close and causing fuel to rise in the fill tube thereby activating an automatic shut off system employed on fuel dispensing systems. The vapor bubble area provides a space for expansion of the fuel during operation of the vehicle as well as a vapor recovery area within the tank.

Fuel tanks are often constructed of a multi-layer plastic material to prevent the escape of hydrocarbon emissions therethrough. Any interruption in the tank wall, such as a hole to mount a valve, requires sealing the hole. Each seal around a hole presents an opportunity for the escape of hydrocarbon vapors therethrough. With this in mind, it is desirable to minimize the number of interruptions or openings in the tank wall.

One of the problems encountered with prior art vapor-recovery apparatus is that they often employ multiple valves requiring multiple installations in the fuel tank. It would be desirable to minimize the number of installations in a fuel tank to minimize the number of interruptions in the fuel tank wall. It is desirable, however, to minimize the volume of the vapor bubble area in the tank. Due to the nature of the phenomenon, the vapor bubble portion of the tank is provided along the top area of the tank. The area external of the tank surrounding the bubble may be space which is not utilized in the vehicle design. As such it would be desirable to maximize the amount of usable space in the vehicle design. Alternatively, the vehicle must be altered in order to accommodate this vapor bubble in its design. As such, it would be desirable to minimize or eliminate the need to provide a vapor bubble area of a fuel tank.

Vapor recovery systems capture and recover escaping fuel vapor during the fueling process or event as well as during operation of the vehicle. The system to recover vapors escaping from the fuel tank through the system may employ a charcoal-filled canister which is designed to capture and store fuel vapors that are generated and displaced from the fuel tank during refueling and operation.

Such fuel recovery devices may be damaged if liquid fuel is introduced. As such, it is desirable to prevent the flow of liquid fuel from the tank to the vapor recovery canister. While a variety of apparatus have been designed to provide blocks and baffles to prevent liquid fuel from flowing from the tank to the vapor recovery canister, it would be desirable to provide an apparatus which prevents the flow of liquid fuel from the tank to the vapor recovery device as well as providing back up vapor and liquid control in the event of failure of the refueling valve. Allowing the liquid to be contained and provides a path for the liquid to reenter the tank.

Additionally, it would be desirable to provide a vapor recovery system which prevents the escape of fuel from the fuel tank during any angular condition of the vehicle, including, but not limited to, a roll over condition. A roll over condition occurs when the vehicle is substantially tilted or inverted. Under such conditions, the vapor recovery apparatus must be closed and sealed to prevent the escape of liquid fuel from the inverted tank and through the vapor recovery system.

BRIEF DESCRIPTION OF THE DRAWINGS

The detailed description particularly referring to the accompanying Figures in which.

DETAILED DESCRIPTION

Figure 1:
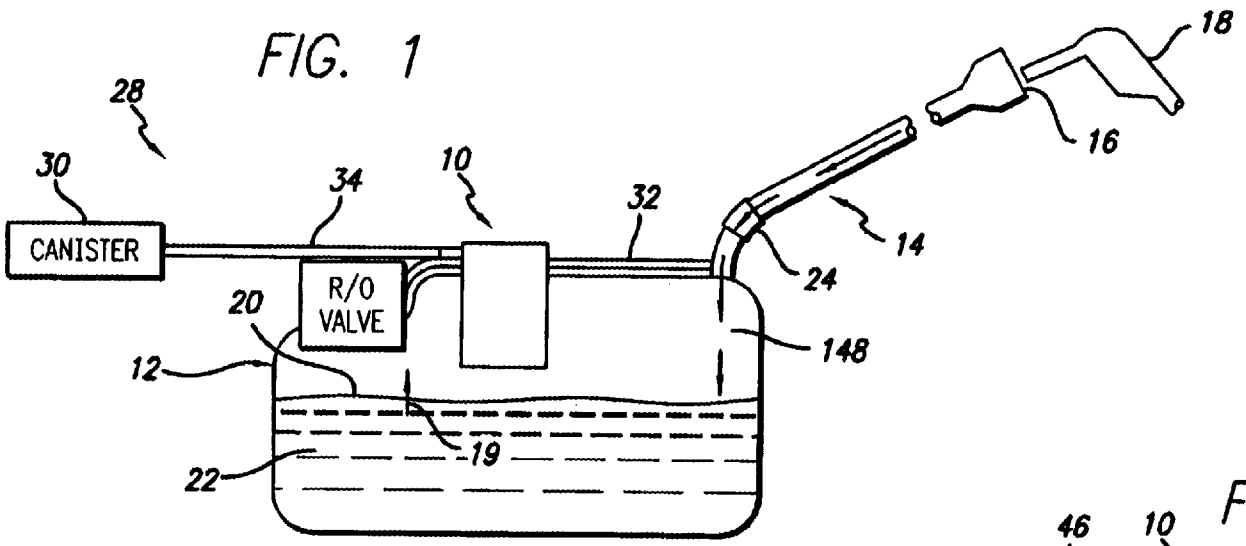
FIG. 1 is a diagrammatic illustration of a tank venting apparatus coupled to a fuel tank, the system includes a fuel-limit and tank ventilation valve.

While the present disclosure may be susceptible to embodiment in different forms, there is shown in the drawings, and herein will be described in detail, embodiments with the understanding that the present description is to be considered an exemplification of the principles of the disclosure and is not intended to limit the disclosure of the details of construction and the arrangements of components set forth in the following description or illustrated in the drawings.

An embodiment of a tank venting apparatus 10 for a fuel tank 12 with a liquid carryover filter is shown in the Figures. As shown in FIG. 1, the tank venting apparatus or a fill-limit and tank ventilation valve 10 as disclosed is mounted in the fuel tank 12 having a filler neck 14. The filler neck 14 has a mouth 16 for receiving a fuel-dispensing nozzle 18 during refueling. The nozzle 18 is used by a fuel pump operator to introduce liquid fuel into the fuel tank 12 during refueling. As the fuel tank 12 is filled during refueling (arrow 19), a top surface 20 of liquid fuel 22 will rise in a generally upward direction. Once the refueling event is completed, a removable cap is used to close the mouth 16 of the filler neck 14. The filler neck 14 may include a check valve 24 or sealing valve structure to prevent the escape of vapors or liquid through the filler neck 14 or tank.

Figure 2:
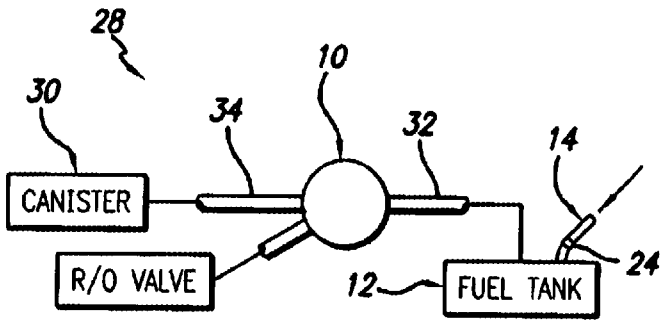
FIG. 2 is diagrammatic illustration of the tank venting apparatus indicating that fuel vapors may be vented to the tank and to the recovery canister.

A vapor recovery system 28 often referred to as a "on-board refueling vapor recovery fuel system" or "ORVR system" 28 is shown in FIG. 2. The ORVR system 28 includes a vapor recovery canister 30 designed to capture and store fuel vapors that are generated and displaced in a fuel tank 12 during vehicle refueling events and vehicle operation. The ORVR system 28 also includes the inlet valve and a "run-loss" valve. As described in detail below, the run-loss valve of the present invention is incorporated in the fuel-limit and tank ventilation valve, tank venting apparatus, or venting control system 10. The valve communicates via line 32 with the fill neck 14 and via line 34 the canister 30. During a refueling operation, a portion of the vapor flows from the valve 10 through the line 32 coupled to the filler neck 14 and returns to the fuel tank 12. Alternatively, vapor can flow from the valve 10 to the vapor recovery canister 30 for controlled purging and combustion during the combustion cycle of the engine.

Figure 3:
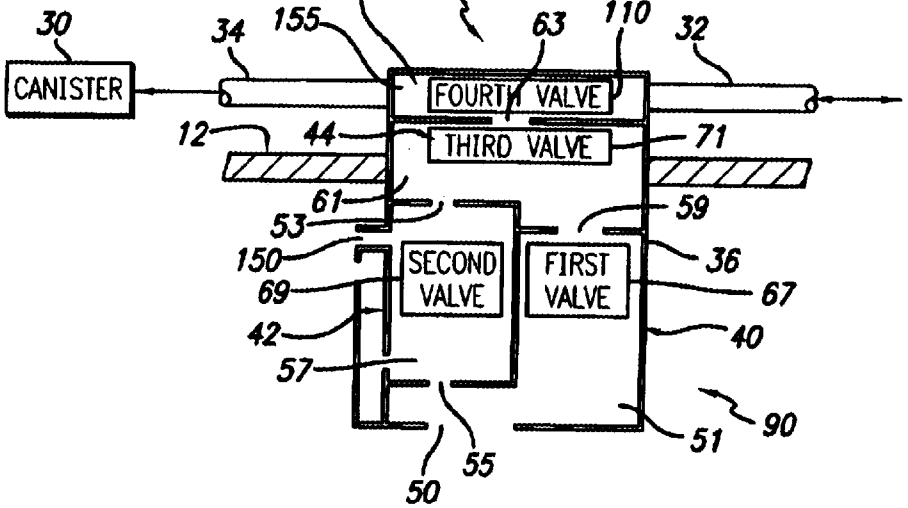
FIG. 3 is a diagrammatic illustration of the apparatus employing a first valve, second valve, third valve and fourth valve.

Turning now to FIG. 3, a diagrammatic illustration is provided. This diagrammatic illustration shows the valve 10 having a housing 36 which contains a first valve assembly 40, second valve assembly 42, third valve assembly 44 and fourth valve assembly 46. The first valve assembly 40 primarily communicates with the fuel tank 12. The fourth valve assembly 46 communicates with the vapor recover canister 30 and the filler neck 14. The first valve assembly 40 also communicates with the third valve assembly 44 and the second valve assembly 42. The second valve assembly 42 generally communicates with the first valve assembly 40 and the third valve assembly 44. The third valve assembly 44 communicates with the first valve assembly 40, second valve assembly 42 and fourth valve assembly 46.

The valve configuration is shown diagrammatically in order to provide an explanation of the system in its broad terms. A description of the embodiment, based on this diagrammatic illustration is provided below. Based on these teachings and the additional teaching set forth below one of ordinary skill in the art would be able to devise various embodiments of disclosed tank vent valve 10 employing various mechanisms as equivalents of the valve assemblies 40, 42, 44, 46 within the housing 36.

In use, with reference to the diagrammatic illustration of FIG. 3, during a refueling event the first valve assembly 40 is operated so that as fuel rises in the fuel tank 12 it flows through a control valve inlet 50 and into a first valve chamber 51 within the housing 36. When the fuel has risen to a predetermined level, a first valve 67 in the valve assembly closes a first valve outlet 59 to generally stop the flow of fuel to the third valve assembly 44. Fuel flows through an intermediate passage 55 to a second valve chamber 57. As fuel rises in the second valve chamber 57, a second valve 69 operates to close a second valve outlet 53 to generally stop the flow of fuel from the second valve chamber 57 to the third valve assembly 44.

If fuel flows from either the first valve 40 or second valve assembly 42 to a third valve chamber 61, the third valve 71 of the valve assembly 44 will rise on the increasing level of liquid fuel in the third valve chamber 61 to close a corresponding third valve outlet 63. As such, if fuel flows through the first valve outlet 59 or the second valve outlet 53 into the third valve chamber 61, sufficient accumulation of fuel in the chamber 61 will cause the third valve 71 to close the third valve outlet 63 to prevent the flow of fuel therefrom. Operation of the first 67, second 69 and third 71 valves generally is sufficient to prevent the escape of liquid fuel from the valve assembly 40 and into the canister 30.

Turning now to FIGS. 4–16 which illustrate the structure and function of an embodiment of the venting apparatus as disclosed, it should be noted that reference to FIGS. 1–3 will be incorporated throughout the following disclosure. The term tank venting apparatus is to be interpreted broadly as including the venting control system, venting control apparatus and other related terms relating to the present disclosure. Additionally, reference to valve assemblies and other structures are to be broadly interpreted as including the specific structure disclosed as well as similar or equivalent devices and structures which now exist or which may come into existence and which are entitled to the fullest degree of protection.

Figure 4:
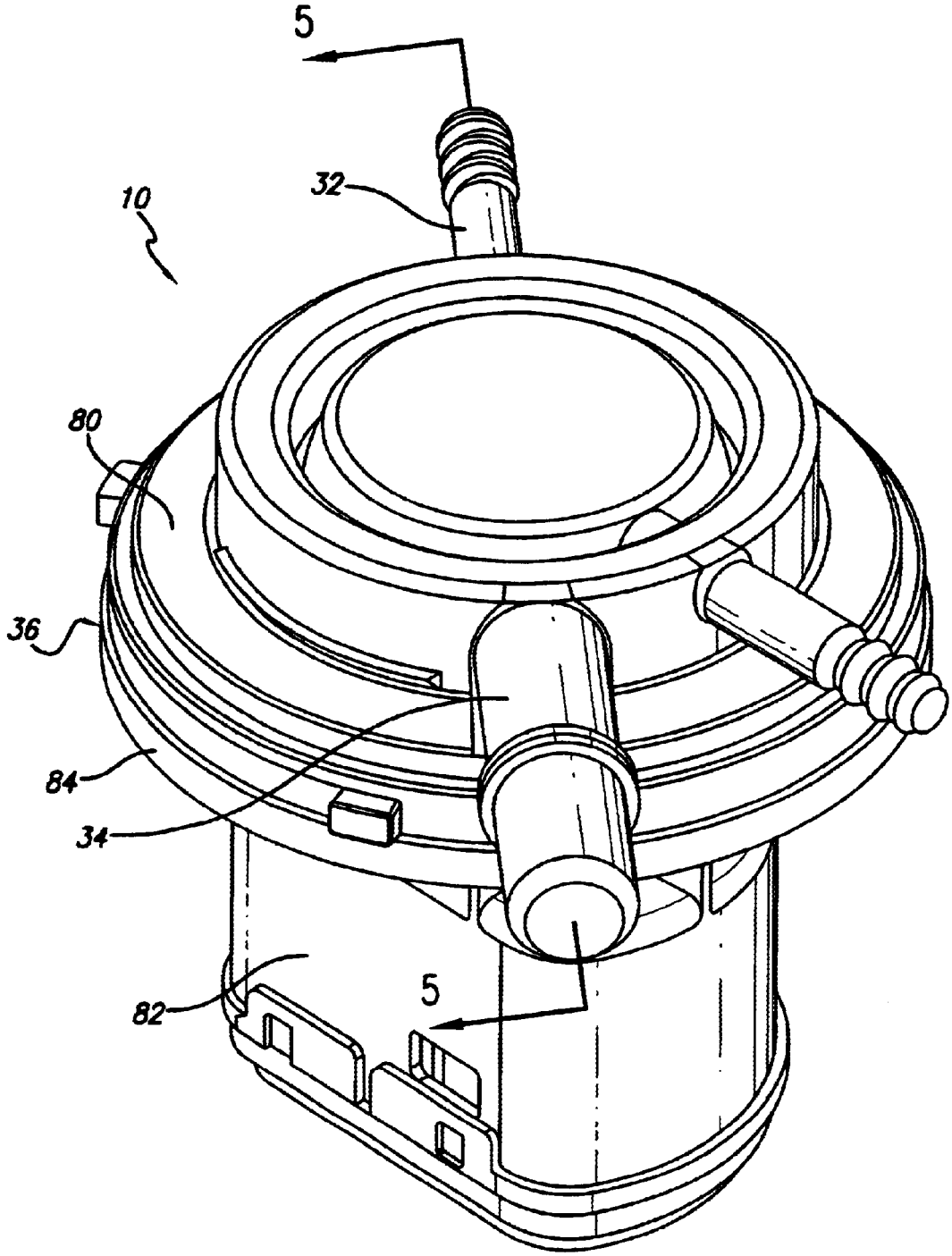
FIG. 4 is an exterior perspective view of an embodiment the apparatus.
Figure 5:
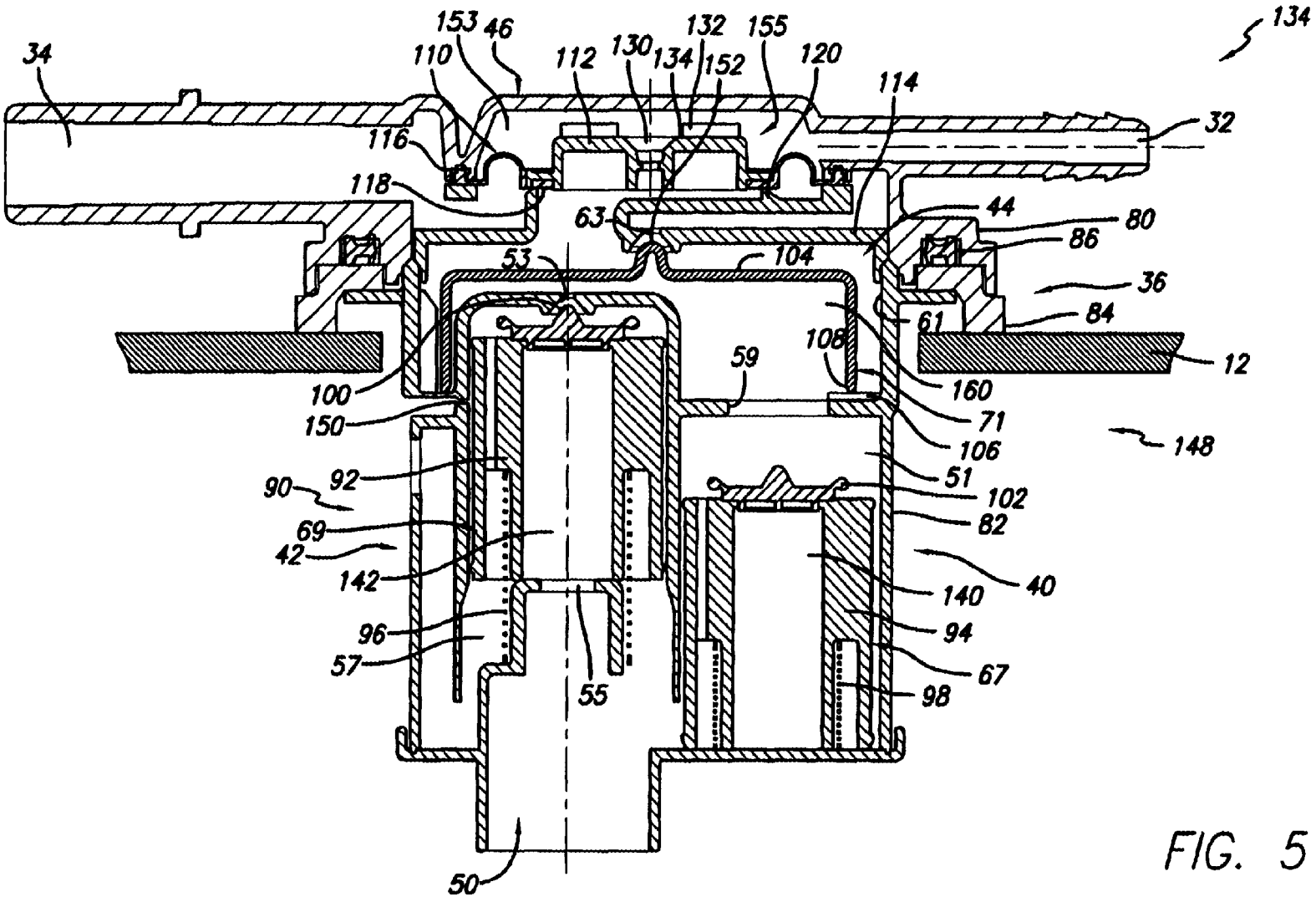
FIG. 5 is a diagrammatic illustration of a cross sectional view taken along line 5—5 in FIG. 4.

FIG. 4 is an illustration of an exterior perspective view of an embodiment of the tank venting apparatus 10. With further reference to the cross sectional diagrammatic view of FIG. 5, the housing 36 includes an upper housing 80, a float housing 82, and a weld ring or attachment structure 84 retained therebetween. With reference to FIG. 5 and the other Figures, a seal 86 is retained between the upper housing 80 and the weld ring 84 to seal the flow of vapor therebetween. As shown in FIG. 5, the weld ring 84 is formed of a suitable material which can be welded directly to the fuel tank 12 or attached or bracketed to mount on the inside of the tank. It is expected that one of skill in the art will be able to devise ways of attaching the apparatus 10 to the tank 12. This configuration allows the tank venting apparatus to be formed of a suitable material to provide the mechanical and structural characteristics required for the operation of such a device. The material used for forming the tank venting apparatus may be incompatible for welding directly to the fuel tank 12 and as such the weld ring 84 provides this structure and function.

With reference to FIG. 5 a cross sectional view in a generally diagrammatic form of the tank venting apparatus 10 is shown. FIG. 5 shows the components of the apparatus 10 in a rest or normal condition. In other words, there are no vapors, fuel or other forces operating on the apparatus 10. For example, with regard to the first and second valves 67, 69, of the valve assemblies 40, 42 collectively a control valve system 90, each of these valve 67, 69 include a float 92, 94, a spring 96, 98, and a seal 100 102 respectively. The springs 96, 98 provide a generally neutral buoyancy of the floats 92 at rest to provide a desired responsiveness of the floats 92, 94 when acted on by fuel in the tank. As shown in FIG. 5, the corresponding seals 100, 102 are not engaged with the respective corresponding first valve outlet 59 and second valve outlet 53. In a similar manner, the third valve assembly 44 is configured as a float 104 retained within a corresponding chamber 61 communicating with the outlets 53, 59 but not sealing the corresponding third valve outlet or flow valve inlet 63. It should be noted that the third valve chamber 61 includes ribs 106 which allow for passage of vapor flow underneath a corresponding edge 108 of the float 104.

As also shown in FIG. 5, the fourth valve assembly in the form of a diaphragm valve 46 includes a diaphragm portion 110 and a diaphragm backing plate or body 112. A diaphragm support plate 114 is provided and can be attached to the upper and lower upper housing 80 and float housing 82 to provide engagement of a perimeter portion 116 of the diaphragm 110 to provide a seal therebetween. Also, a radially inwardly disposed seal portion 118 of the diaphragm 110 abuts a corresponding sealing surface 120 of the support plate 114 to provide a seal therebetween.

As will be shown in the Figures, first valve assembly 40 will receive liquid fuel into the first valve chamber 51 thereby floating the float portion 94 of the valve assembly 40 upwardly in the chamber 51. When liquid fuel has raised to a sufficient level within the tank 12, the seal 102 will seal the opening 59 generally preventing the escape of vapor therethrough. Upon further introduction of fuel into the tank 12, the fuel will be rise to a level in the second valve chamber 57 to cause the float portion 92 of the second assembly 42 to rise upwardly. Continued introduction of fuel will cause the float 92 to rise to a level whereby the seal 100 will seal the opening 53.

The diameter of the passage 59 is larger than the diameter of the passage 53 so as to accommodate a larger volume of vapor flow therethrough during an initial refueling event. Once the seal 102 has closed the opening 59, continued vapor flow from the tank through the opening 53 will be permitted until the seal 100 is raised to a level to close the opening 53. Generally, when both floats 92, 94 have raised to a point where the seals 100, 102 close the corresponding openings 53, 59, back pressure will be created in the tank 12 and up through the filler neck 14 causing the pressure backup at the check valve 24. This will provide a signal back to the dispensing nozzle 18 thereby shutting off the fuel pump.

Figure 6:
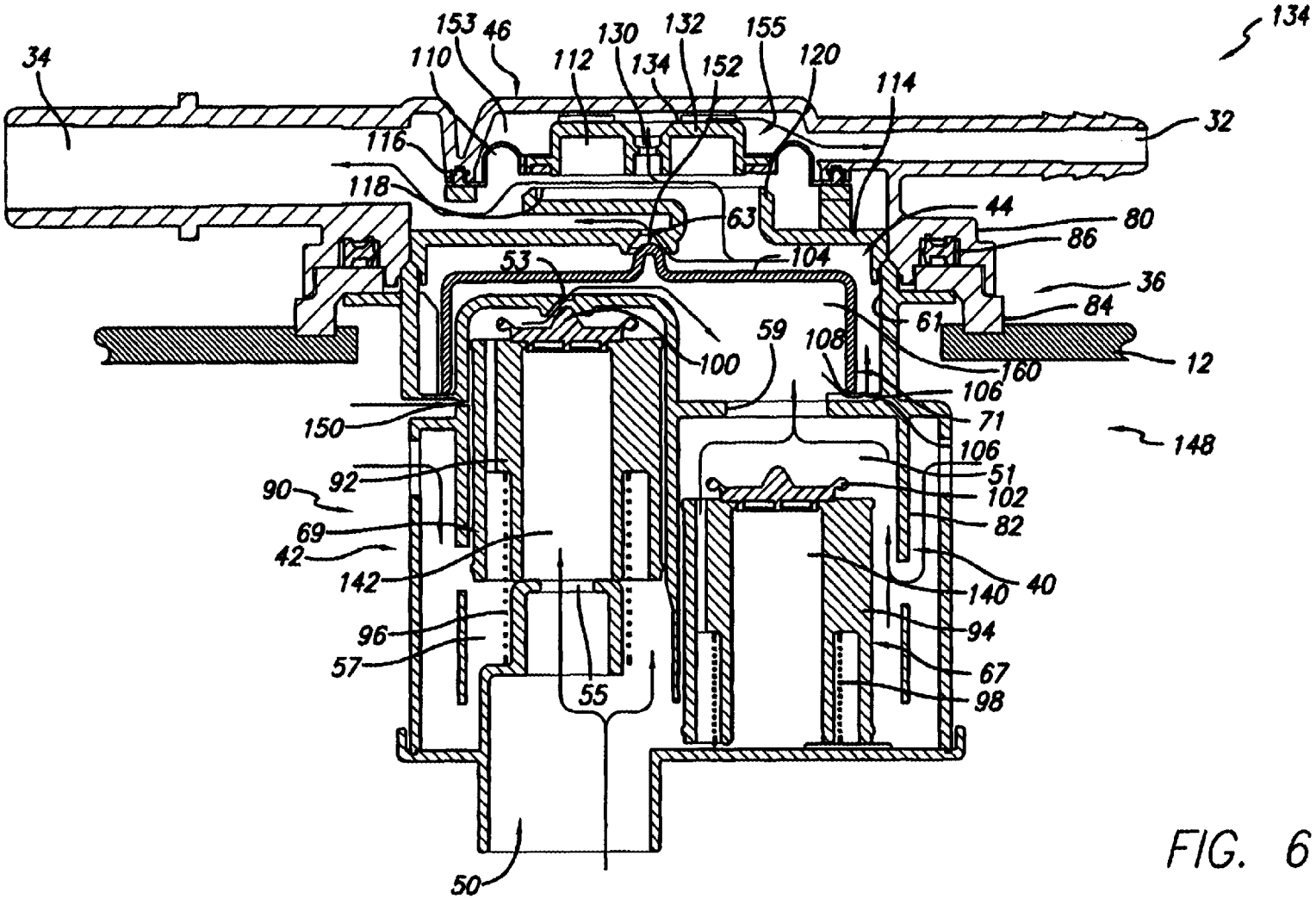
FIG. 6 is a diagrammatic illustration similar to that as shown in FIG. 5 showing the condition of the tank venting apparatus showing the flow of vapors prior to initial shut off during a refueling event.

Reference to FIGS. 6–16 is provided to describe progressive and various operating modes of the control system 10. Turning now to FIG. 6, various vapor flow paths are shown flowing through the vent control system during a refueling event. This shows the flow of the vapor therethrough before the initial shutoff. In the progressive view of FIG. 6, pressure has developed within the tank 12 to a degree which causes the diaphragm 110 of the valve 46 to rise upwardly from the increased pressure. This allow venting of vapors to the canister 30. Also, a portion of the vapors will be vented through a vapor recovery orifice 130 in the body 112. Ribs 132 are provided on an upper surface 134 of the body 112 to maintain a vapor flow from the venting control valve 10 through the signal line 32. Fuel vapors circulating through the signal line 32 will be recycled through the fill tube 14 to the tank 12.

Figure 7:
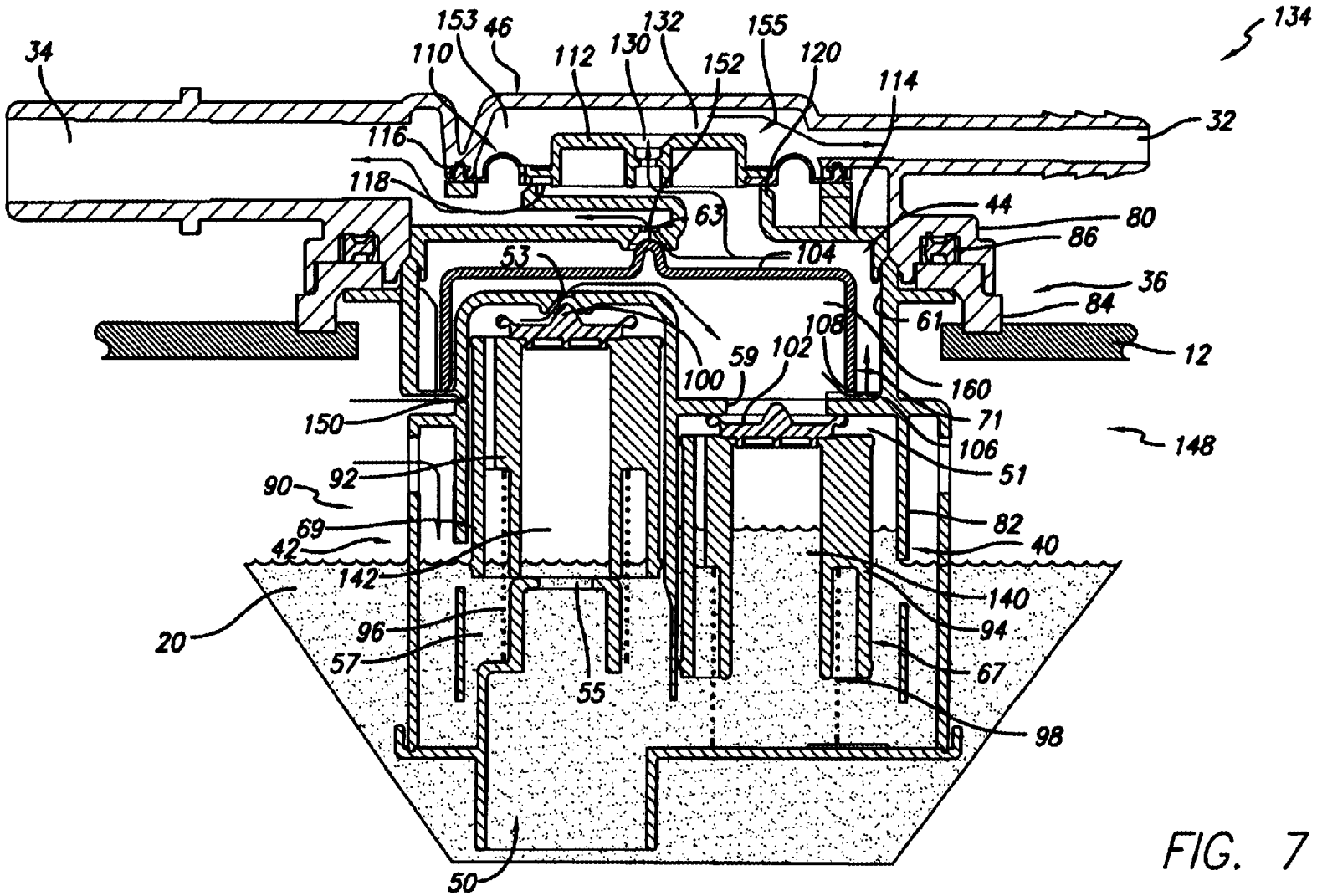
FIG. 7 is a diagrammatic illustration similar to that as shown in FIGS. 5 and 6 of the tank venting apparatus showing the vapor flow after initial shut off after a refueling event.

Turning to FIG. 7, an initial shutoff condition is shown which occurs during a refueling event. Under these circumstances, fuel 20 has risen to a level within the tank 12 to cause the float 94 to rise to a position whereby the seal 102 closes the opening 59. As shown in FIG. 7, the level of the fuel in an interior portion or chamber 140 in the float 94 may be higher than that as shown in a chamber 142 in the float 92 as a result of increased pressure in the tank pushing the fuel upwardly therein as a result of the closing or seal provided by the seal 102 over the opening 59. Additionally, the event as shown in FIG. 7 is prior to the closing of the opening 53. As such, vapor is allowed to pass through the opening 53 and continue to vent through the signal line 32 and the canister line 34. Generally, vapor will take the path of least resistance. As also shown in FIG. 7, the smaller diameter opening 53 restricts the flow of vapor therethrough thereby reducing the pressure in the third valve assembly 44 and fourth valve assembly 46. As a result, the diaphragm 110 will drop thereby sealing the seal portion 118 against the sealing surface 120. This results in further restriction of flow to the canister passage 34.

Figure 8:
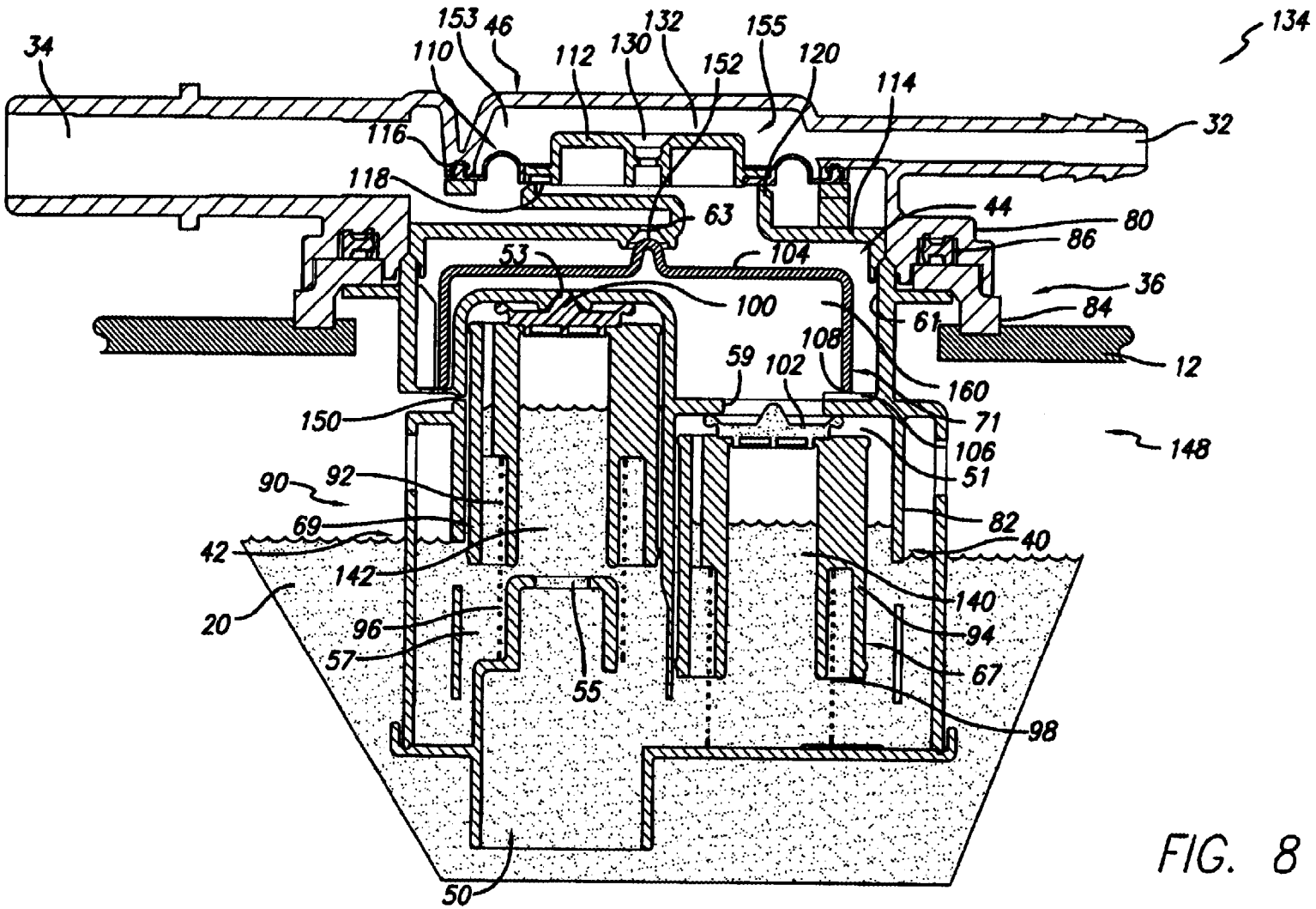
FIG. 8 is a diagrammatic illustration similar to that as shown in FIGS. 5–7 during which the first and second valves are closed at final shut off at the end of a refueling event at a specific time in the refueling cycle.

Turning to FIG. 8, continued dispensing of fuel 20 into the tank 12 causes the float 92 to rise upwardly causing the seal 100 to seal against the opening 53. In this condition, increased pressure in an open area 148 of the tank will cause the fuel dispensing system to shut off by preventing further dispensing of fuel into the tank. Under the conditions as shown in FIG. 8, further venting of vapors will not occur through the venting control valve 10.

It should be noted that FIG. 8 generally shows a momentary condition generally during the round-off portion of a refueling event. Round-off occurs when the party dispensing fuel into the tank makes further attempts to continue dispensing fuel into the tank after the fuel dispensing system has automatically shut off. Automatic shutoff devices have been incorporated into fuel dispensing systems to prevent overfilling the tanks and filling fuel. As a result, it is not uncommon for the person dispensing fuel into the tank to top off the tank or round off the purchase price of the fuel. Hence, the term "round-off." At some point, the rounding off will stop and the fueling event will be concluded.

Figure 9:
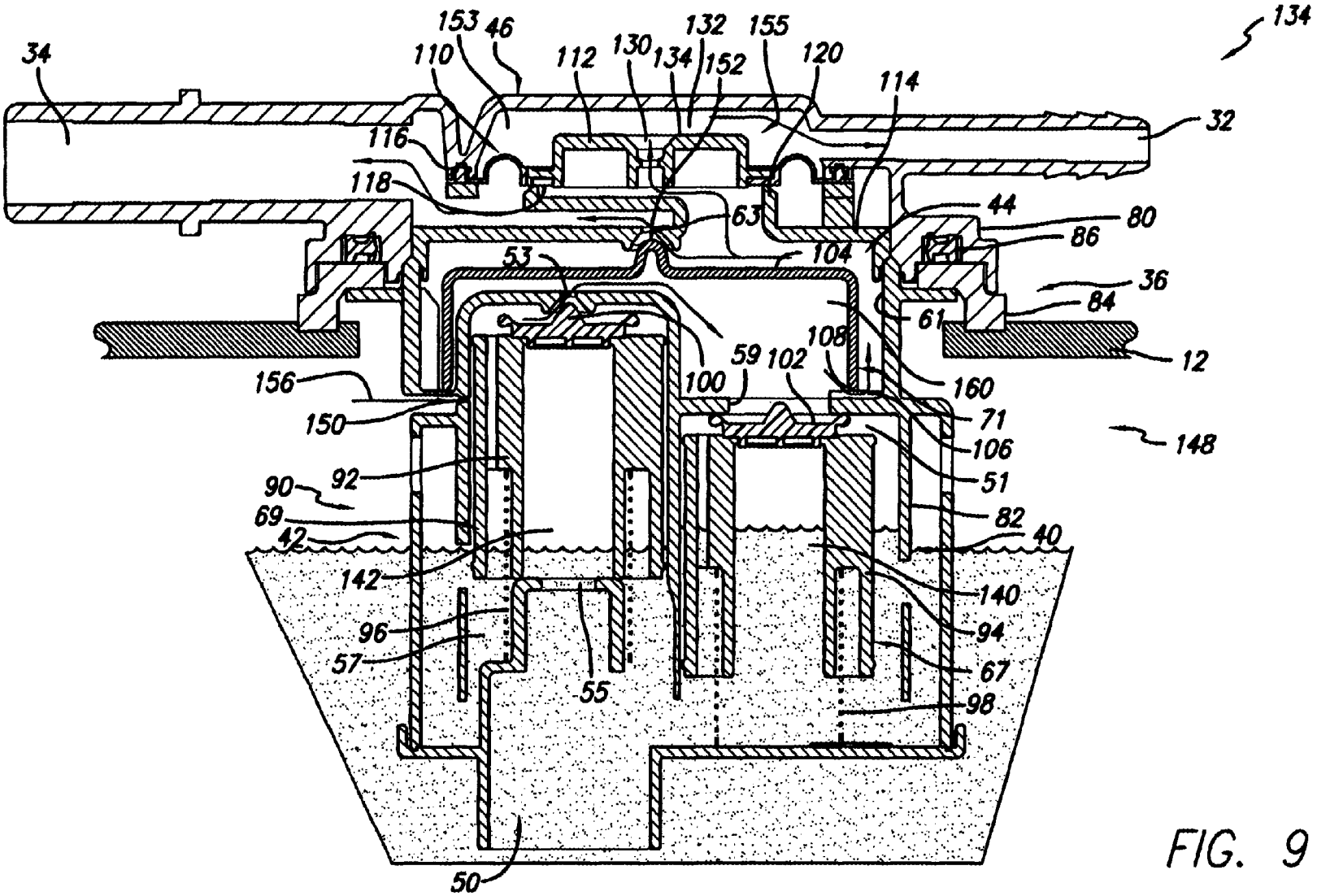
FIG. 9 is a diagrammatic illustration similar to that as shown in FIGS. 5–8 and showing vapor venting after the final shut off after a refueling event.

Turning to FIG. 9, after conclusion of the refueling event and closing of the fuel system with an appropriate cap, the pressure in the tank will tend to drop. Even if the pressure in the tank does not drop, consumption of fuel will occur during vehicle operation. After the refueling event and perhaps some period of vehicle use, eventually, the system reaches a state as shown in FIG. 9 whereby the valve assembly 40 maintains a seal 102 over the opening 59 but, the run-loss valve 42 reaches the state whereby the float 92 has descended within the chamber 57 to cause disengagement of the seal 100 from the opening 53. There may be a condition whereby vapor cannot flow through the chamber 57 from a position below the float 92. As such, a breather vent 150 is provided to allow controlled passage of vapor therethrough into the chamber 57 and through the opening 53. Vapor will flow through the valve 110 as described above for recirculation through the signal line 32 as well as passage to the canister 30 and subsequent combustion therefrom.

Figure 10:
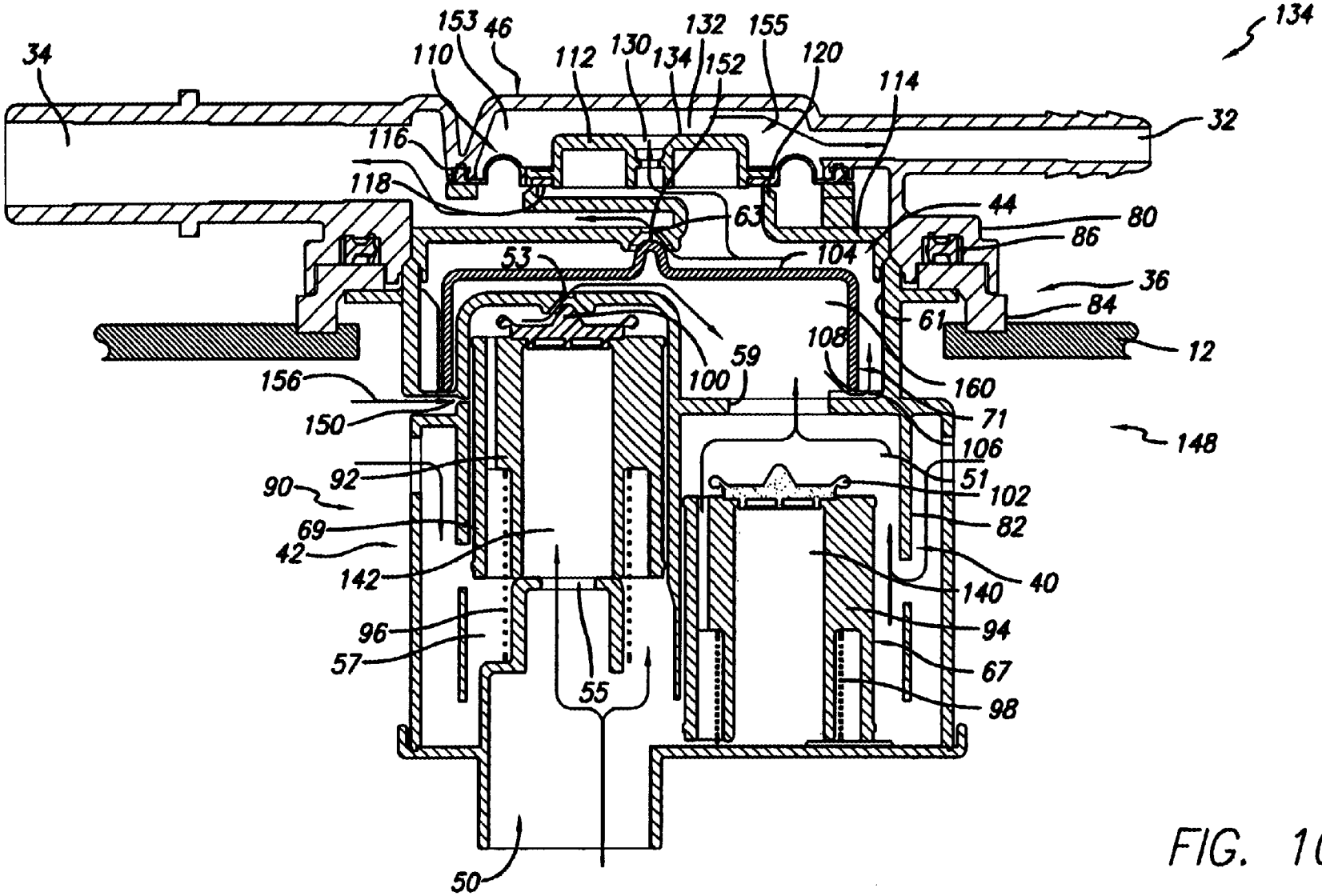
FIG. 10 is a diagrammatic illustration similar to that as shown in FIGS. 5–9 showing venting of vapors during normal operation while the vehicle carrying the tank and the tank venting apparatus is in normal use.

FIG. 10 shows operation of the control valve 10 under normal operating conditions such as when the vehicle is being driven. As can be seen, vapor flows from the tank 12 through the first and second valve assemblies 40, 42, through the third valve assembly 44 exiting through the outlet 63. The flow can pass through the outlet 63 to the canister line 34 or through the vapor recovery orifice 130 to the signal line 32 and recycle back to the tank 12. The smaller diameter of the outlet 63 lets vapor flow to the canister 30 and also prevents surges of vapor to the canister. This reduces the flow of vapor to the canister, thereby not overly taxing the canister. Also, this allows an onboard fuel maintenance computer system, of known construction, carried on the vehicle to manage the accumulation of fuel vapor in the canister to efficiently burn the vapors from the canister periodically. This also prevents surges which generally cannot be accommodated by the onboard computer. In other words, the onboard computer typically cannot react fast enough to a surge and as such preventing surges helps to improve the efficiency and life of the vapor recovery system.

Figure 11:
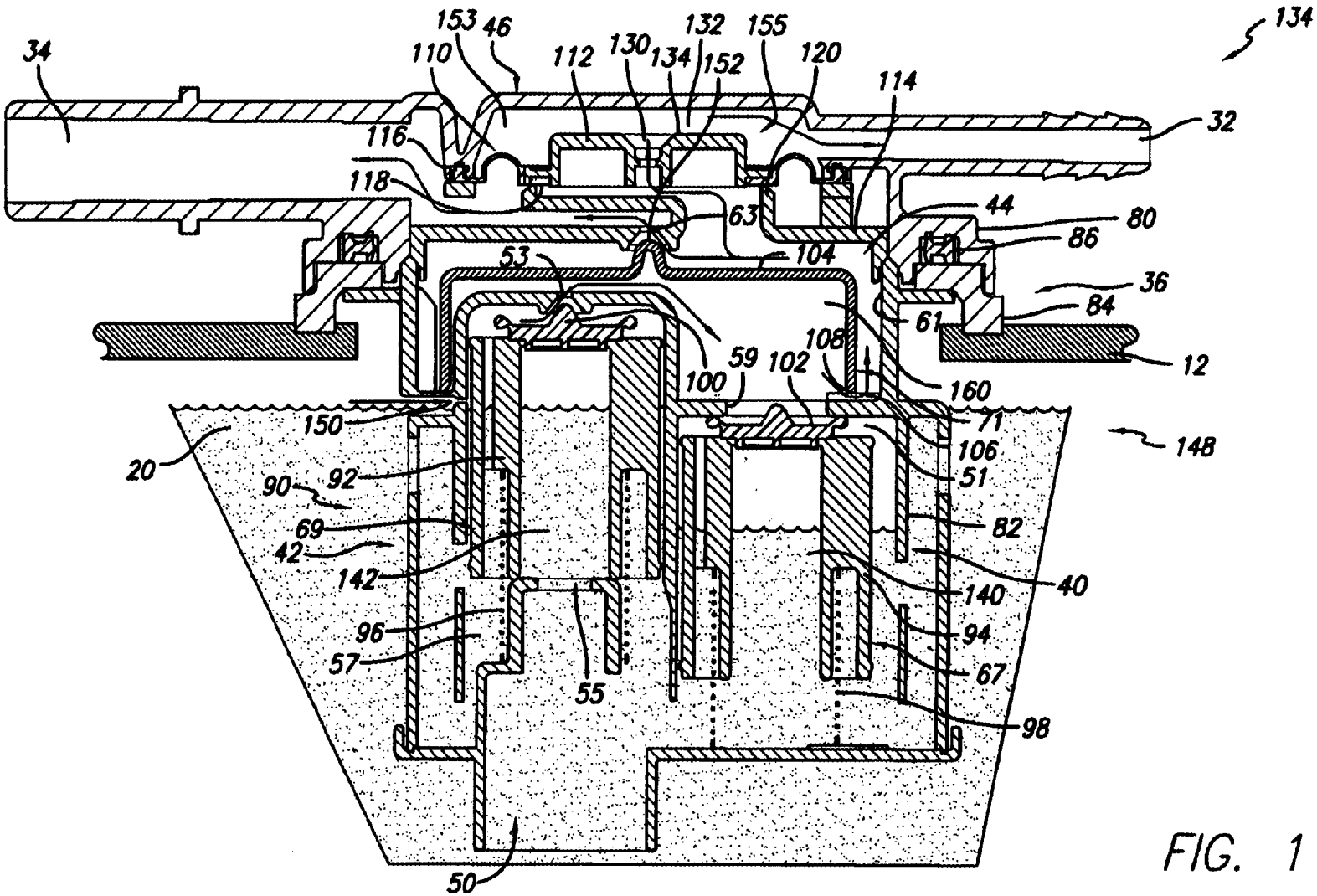
FIG. 11 is a diagrammatic illustration similar to that as shown in FIGS. 5–10 showing venting of the tank venting apparatus allowing fuel vapor from the tank flow through the apparatus to the canister.

FIG. 11 shows a condition whereby the vehicle is tipped in a direction such that fuel in the tank flows toward the venting control valve 10. For example, if a vehicle is parked on a hill or incline the fuel will tend to accumulate or flow towards one side of the tank. Under these conditions, for example, an extended time of parking on such an incline, the system will still need to vent vapors. Under these conditions, the first valve assembly 40 will typically close the opening 59 as a result of float 94 floating upwardly and seal 102 covering the opening 59. Typically, at least the breather vent 150 will be exposed allowing vapor to flow therethrough to the chamber 57 and out through the opening 59. Vapor will flow through the third valve chamber 61, fourth valve assembly 46 and to the canister 30. As such, even under these conditions the venting control valve 10 will vent vapors to the canister to prevent escape to the atmosphere.

Figure 12:
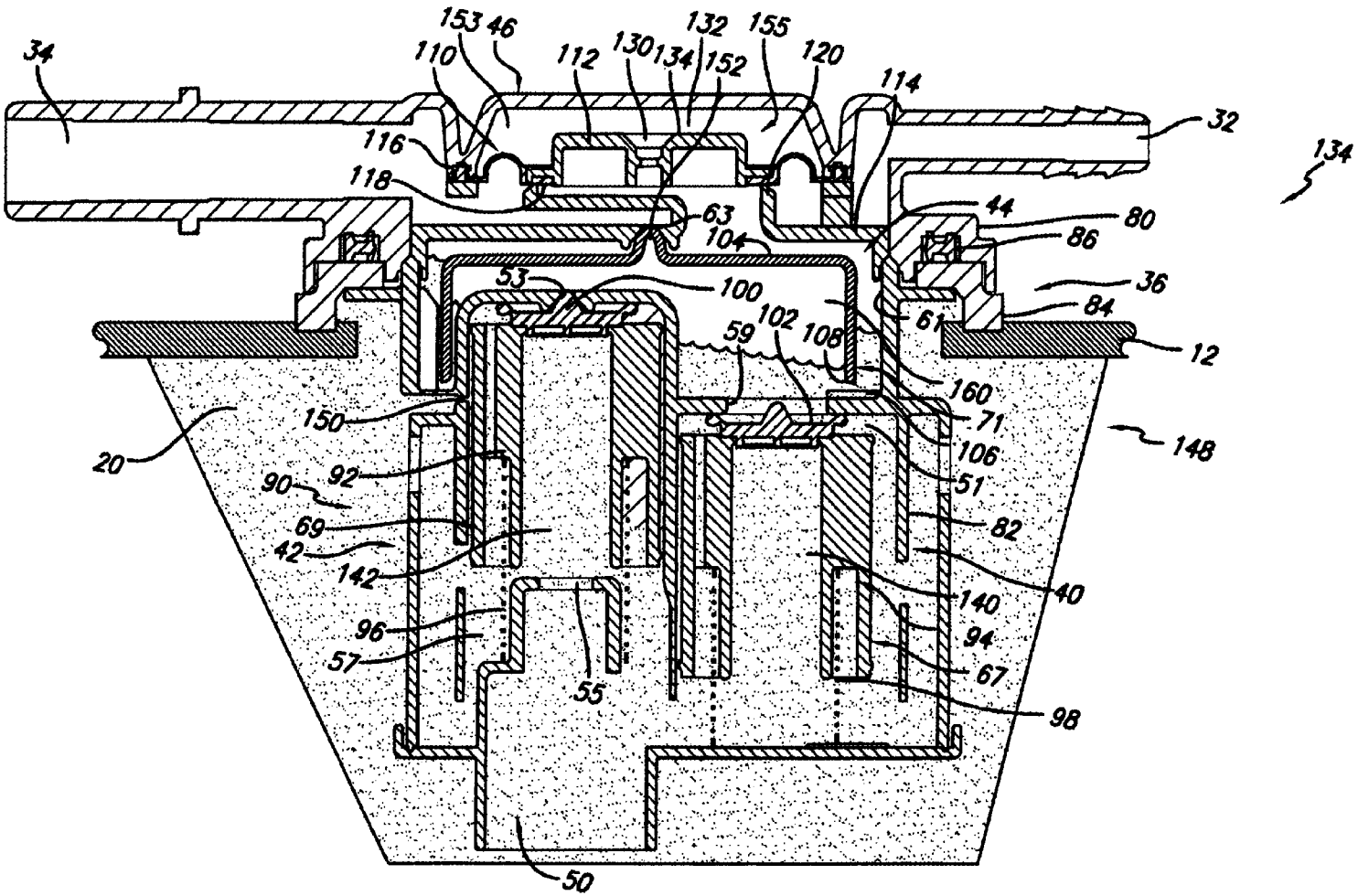
FIG. 12 is a diagrammatic illustration similar to that as shown in FIGS. 5–11 in which the third valve or liquid separation valve prevents liquid from flowing to the associated canister even in the event of a failure of at least one of the first and second valves.

Turning to FIG. 12, the valve 10 is shown in a condition which may occur under a variety of circumstances. Under the circumstances, as will be explained, the vent valve prevents flow of liquid fuel from the tank 12 to the canister 30. In this manner, the canister does not become saturated or flooded with fuel and as such is not damaged.

Circumstances which might cause a situation such as shown in FIG. 12 might include some form of particle, for example, as grass or metal shavings entering the fuel tank and becoming lodged in a portion of the valve causing the first valve assembly 40 or second valve assembly 42, or both, fail to seal or to leak. Under these circumstances, fuel may flow into the third valve chamber 61. However, the third valve 71 in the chamber 61 will float on rising fuel level within the chamber 61. At a predetermined level, the rising fuel in the chamber 61 will cause a nipple 152 on the third valve 71 to engage the opening 63 thereby closing or sealing the chamber 61. Closing of the chamber 61 prevents the flow of liquid fuel through the canister line 34 and thereby prevents contamination of the canister with liquid fuel. The third valve assembly 44 is also referred to as a liquid/separation or liquid discriminator valve, or an overlying valve. The cup-like form of the valve 71 captures a portion of atmosphere within the tank causing it to be buoyant within the chamber 61. Buoyancy forces the nipple 152 into the opening 63 thereby closing or sealing the opening.

Figure 13:
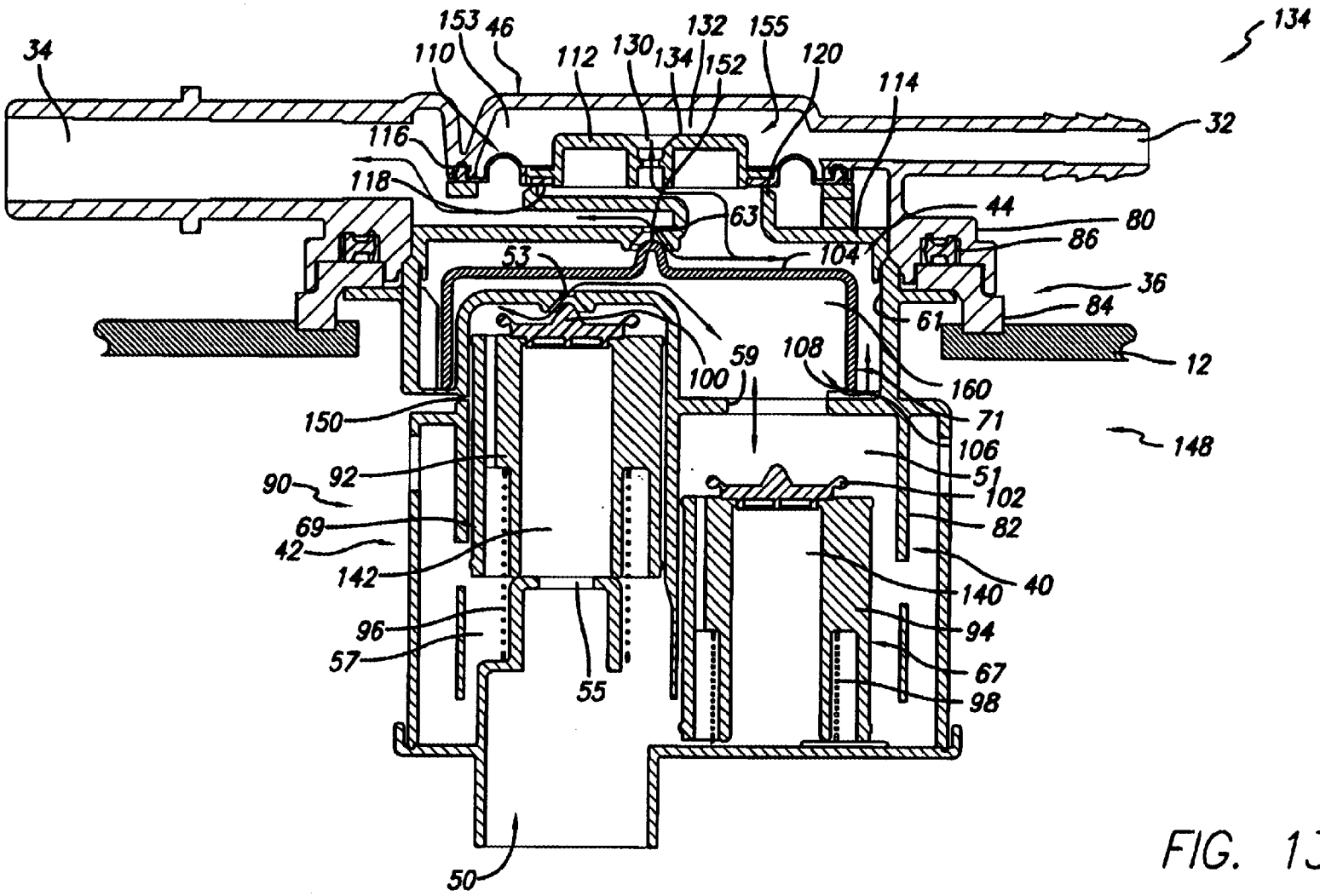
FIG. 13 is a diagrammatic illustration similar to that as shown in FIGS. 5–12 in showing operation of the tank venting apparatus during a diagnostic system leak sensing test.

FIG. 13 shows the venting control system or venting control valve 10 in a condition in which an onboard diagnostics system of known construction carried on the vehicle applies a vacuum to the fuel system to sense leaks. The onboard diagnostics system is coupled to the vehicle fuel level gauge to determine whether the conditions are suitable to conduct a leak test. For example, when the tank is at 85% capacity, the onboard diagnostics system may conduct a leak test. When these conditions are met, the onboard diagnostics system will operate a vacuum pump to create a vacuum or draw a vacuum on the fuel tank. The system can also operate using a pressure to detect leaks. Further, the system can utilize natural forces vacuum or pressure which can be developed naturally in the tank as a result of heating and cooling of fuel in the tank. The system will compare the conditions sensed to a benchmark calculation programmed into the system. If the system detects a leak, the vehicle operator will be notified. Under this testing condition, the valve 10 needs to be able to allow flow through the various openings to emulate conditions of the valve 10 relative to the benchmark condition.

Figure 14:
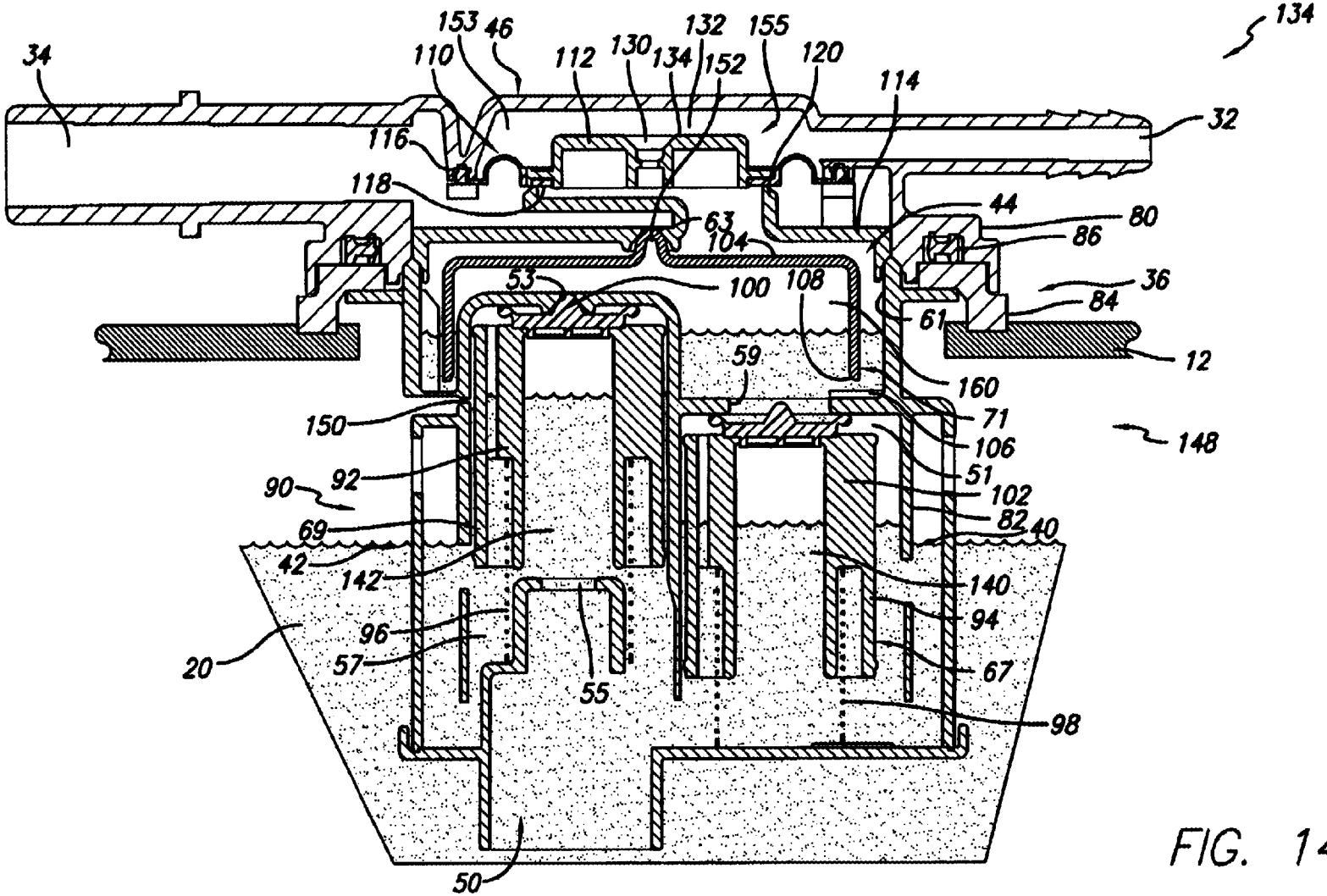
FIG. 14 is a diagrammatic illustration similar to that as shown in FIGS. 5–13 and in which a fill nozzle protection system has failed resulting in fuel flowing through a signal line and into the tank venting apparatus yet blocking flow to the canister.

FIG. 14 shows a condition which creates a response in the valve 10 which is similar to that shown in FIG. 12. FIG. 14, illustrates a condition in which the fuel dispensing nozzle 18 (see FIG. 1) may have failed. As a result, fuel flows through the signal line 32 to the fourth valve assembly 46. Under these conditions, the diaphragm 110 closes or seals as a result of accumulation of liquid fuel within an upper portion 153 of a fourth valve chamber 155. The diaphragm seal portion 118 seals against the sealing surface 120. As such, fuel is prevented from flowing into the canister passage 34 and to the canister 30.

It should be noted that this condition usually only occurs when the fuel tank is nearly full. For example, if the tank is not nearly full, fuel will flow through the larger diameter filler tube and not through the signal line 32. As such, this will generally only occur when fuel has risen in the tank to a level causing both the first and second valve assemblies 40, 42 to close thereby causing fuel to back up in the filler neck 14. At some point fuel will flow from the filler neck through the signal line 32 causing the condition as described above. The valve 10 as disclosed accommodates this failure condition by allowing some fuel to accumulate within the third valve chamber 61. As previously described under the conditions illustrated in FIG. 12, fuel will accumulate within the chamber 61 causing the valve body 71 to rise thereby engaging the nipple 152 in the opening 63 preventing flow of liquid fuel into the canister passage 34. It should be noted, if the pressure within the tank drops to a point where the fuel exerts a greater pressure on the seal 102 of the first valve assembly 40, fuel will be allowed to flow into the tank from the chamber 61. However, if the level of fuel in the tank and the corresponding vapor pressure exerts a force on the first valve assembly 40 which is greater than that of the fuel in the chamber 61 the seal 102 will maintain its position covering the opening 59. This circumstance does not create an adverse effect on the third valve assembly 44. To the contrary, the fuel level will build in the chamber 61 causing the valve 71 to float into a closed position. As such, fuel is prevented from flowing to the canister and the system is protected.

Figure 15:
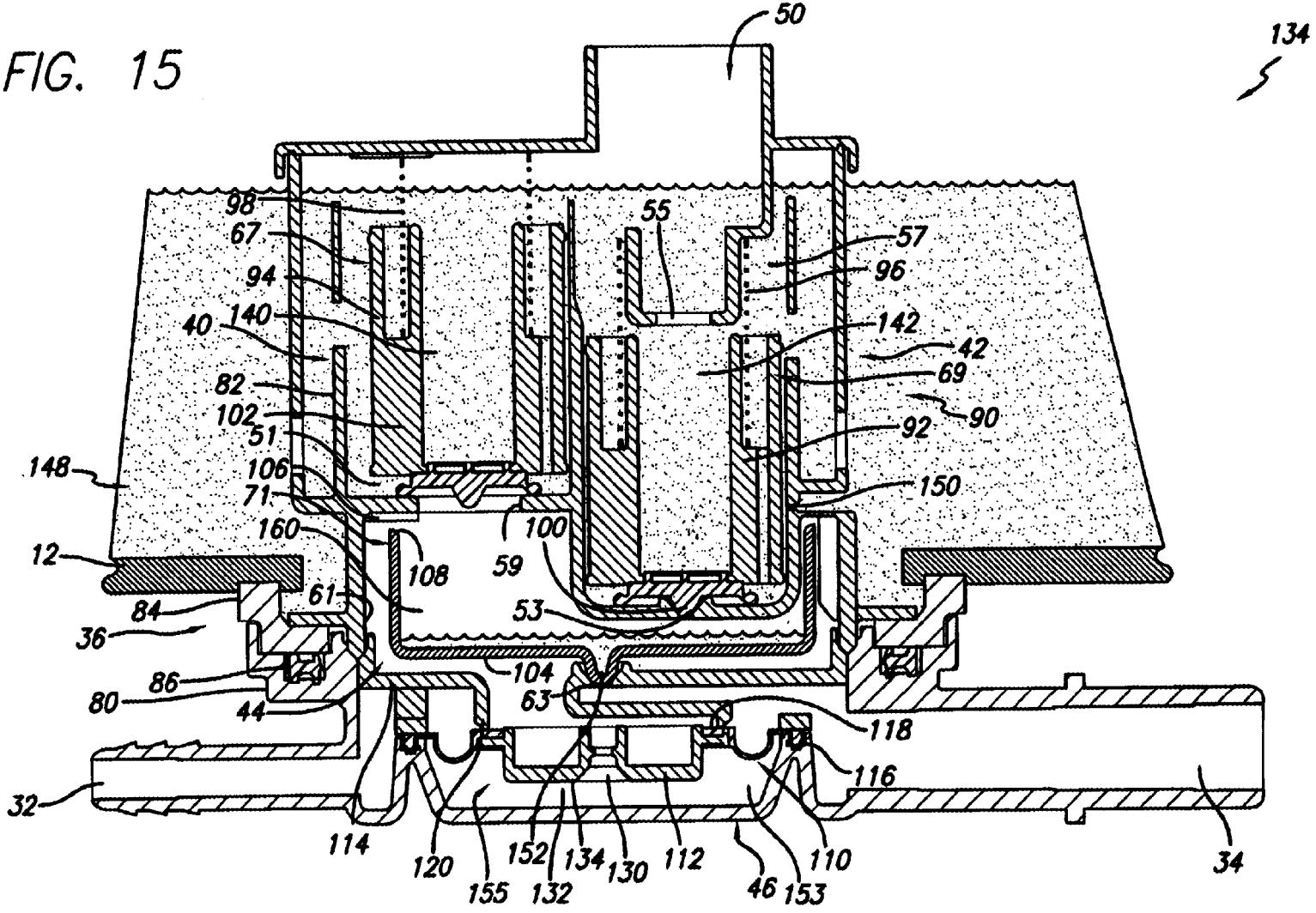
FIG. 15 is a diagrammatic illustration similar to that as shown in FIGS. 5–14 in which the tank venting apparatus is inverted in a "roll-over" condition and further illustrating sealing of the related valves to prevent liquid flow from the tank venting apparatus.

One of the conditions required for venting control systems and valves 10 is to prevent the escape of fuel in a "roll-over" condition. This condition may occur when the vehicle tips over or is otherwise inverted. Preventing escape of fuel from the tank is important in order to prevent escape of fuel onto the vehicle and further damage to the vehicle. As shown in FIG. 15, the rollover condition forces the floats 92, 94 to a downward (inverted) position, causing the seals 100, 102 to securely close the openings 53, 59. Both the first and second valve assemblies 40, 42 substantially prevent any leakage of fluid from the tank. Any minor leakage of fuel which might have occurred immediately prior to sealing of the openings 53, 59 will tend to be accumulated in a cavity 160 defined by the inverted valve 71 of the third valve assembly 44. Also, in the inverted condition, the nipple 152 is securely seated in the opening 63. As such, fuel is prevented from flowing out of the tank.

Figure 16:
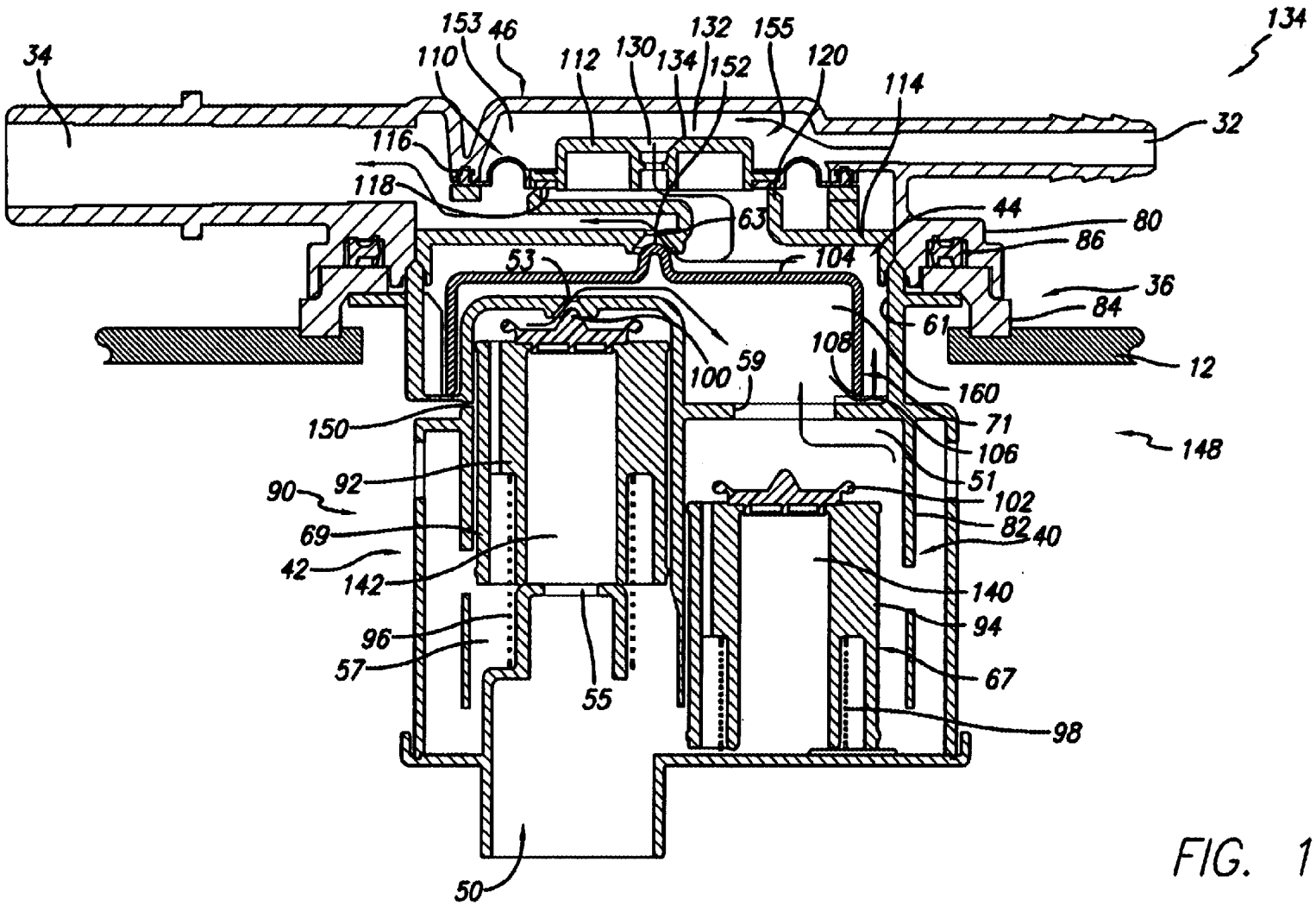
FIG. 16 is a diagrammatic illustration similar to that as shown in FIGS. 5–15 in which the vehicle fuel system is purging the canister and the tank venting apparatus and at which the tank venting apparatus facilitates some degree of adjustability to allow the fuel management system to adjust to provide clean burning of the vapors.

FIG. 16 shows another condition which should be considered for proper operation of venting control systems and valves 10. FIG. 16 shows a condition when a vehicle vapor recovery system is drawing vapors from the canister 30 for combustion. Under these circumstances a slight vacuum is drawn through the system which will tend to promote the removal of vapors from the tank 12. As such, vapors are allowed to flow through the system 10. Similar to the conditions as described above with regard to FIG. 13, vapors will be allowed to freely flow to the system 10 through the canister passage 34 to the canister 30. The dimension of the passage 63 restricts the flow of vapors thereby facilitating a generally consistent flow of vapors to promote clean burning of the vapors from the canister as well as those vapors flowing through the system as the canister is purged.

While embodiments of the disclosure are shown and described, it is envisioned that those skilled in the art may devise various modifications and equivalents without departing from the spirit and scope of the disclosure as recited in the following claims.

What is claimed is:

1. A venting control system for use with a fuel tank, the venting control system comprising:

a housing defining at least a first valve inlet, a first valve outlet, a second valve inlet, a second valve outlet and a third valve outlet;

a first valve assembly in the housing;

the first valve assembly communicating with the first valve inlet and the first valve outlet;

a second valve assembly in the housing;

the second valve assembly communicating with a second valve inlet and second valve outlet;

the second valve inlet communicating with the first valve assembly for facilitating flow of liquid fuel from the first valve assembly to the second valve assembly;

a third valve assembly in the housing;

the third valve assembly communicating with the first valve outlet and the second valve outlet; a vapor recovery passage in the housing communicating with at least the third valve outlet for allowing passage of displaced vapors from the fuel tank to a vapor recovery canister.

2. The venting control system as in claim 1, further comprising:

a fourth valve assembly in the housing; and the fourth valve assembly communicating with the third valve outlet and the vapor recovery passage.

3. The venting control system as in claim 1, wherein the housing contains the first valve assembly, second valve assembly, third valve assembly and fourth valve assembly.

4. The venting control system as in claim 1, wherein only the first valve assembly directly communicates with fuel tank.

5. The venting control system as in claim 1, wherein only the third valve directly communicates with the fourth valve assembly.

6. The venting control system as in claim 1 in combination with a fuel tank.

7. A venting control system for use with a fuel tank, the venting control system comprising:

a housing;

a control valve in the housing;

the control valve having a control valve inlet and a control valve outlet;

a liquid/vapor separator in the housing;

the liquid/vapor separator communicating with the control valve outlet for preventing the passage of liquid fuel from a fuel tank;

a flow management valve in the housing;

the flow management valve including a flow valve inlet and a flow valve outlet;

the flow valve inlet communicating with at least the liquid/vapor separator; and the flow valve outlet being connectable to a vapor recovery canister for controlling passage of displaced vapors from the fuel tank to a vapor recovery canister.

8. A venting control system for use with a fuel tank, the venting control system comprising:

a housing;

a control valve in the housing;

the control valve having a control valve inlet and a control valve outlet;

a liquid/vapor separator in the housing;

the liquid/vapor separator communicating with the control valve outlet for preventing the passage of liquid fuel from a fuel tank;

a flow management valve in the housing;

the flow management valve including a flow valve inlet and a flow valve outlet;

the flow valve inlet communicating with at least the liquid/vapor separator; and the flow valve outlet being connectable to a vapor recovery canister for controlling passage of displaced vapors from the fuel tank to a vapor recovery canister; and wherein the housing containing the control valve, the liquid/vapor separator, and the flow management valve.

9. A venting control system for use with a fuel tank, the venting control system comprising:

a housing;

a control valve in the housing;

the control valve having a control valve inlet and a control valve outlet;

a liquid/vapor separator in the housing;

the liquid/vapor separator communicating with the control valve outlet for preventing the passage of liquid fuel from a fuel tank;

a flow management valve in the housing;

the flow management valve including a flow valve inlet and a flow valve outlet;

the flow valve inlet communicating with at least the liquid/vapor separator; and the flow valve outlet being connectable to a vapor recovery canister for controlling passage of displaced vapors from the fuel tank to a vapor recovery canister; and wherein only the control valve directly communicates with a fuel tank.

10. A venting control system for use with a fuel tank, the venting control system comprising:

a housing;

a control valve in the housing;

the control valve having a control valve inlet and a control valve outlet;

a liquid vapor separator in the housing;

the liquid/vapor separator communicating with the control valve outlet for preventing the passage of liquid fuel from a fuel tank;

a flow management valve in the housing;

the flow management valve including a flow valve inlet and a flow valve outlet;

the flow valve inlet communicating with at least the liquid/vapor separator; and the flow valve outlet being connectable to a vapor recovery canister for controlling passage of displaced vapors from the fuel tank to a vapor recovery canister; and wherein only the liquid/vapor separator directly communicates with the flow management valve.

11. A venting control system in combination with a fuel tank for use with a fuel tank the venting control system comprising;

a housing;

a control valve in the housing;

the control valve having a control valve inlet and a control valve outlet;

a liquid/vapor separator in the housing;

the liquid/vapor separator communicating wit the control valve outlet for preventing the management of liquid fuel from a fuel tank;

a flow management valve in the housing;

the flow management valve including a flow valve inlet and a flow valve outlet;

the flow valve inlet communicating with at least the liquid/vapor separator; and the flow valve outlet being connectable to a vapor recovery canister for controlling passage of displaced vapors from the fuel tank to a vapor recovery canister.

12. A venting control apparatus for use with a fuel tank, the venting control apparatus comprising:

a housing;

the housing defining a first valve chamber;

the housing defining a first valve inlet and a first valve outlet communicating with the first valve chamber;

a first float valve assembly in the first valve chamber;

the housing defining a second valve chamber;

a second float valve assembly in the second valve chamber;

the housing defining an intermediate passage providing communication between the second valve chamber and the first valve chamber;

the housing defining a second valve outlet communicating with the second valve chamber;

the housing defining a third valve chamber;

the housing defining a third valve outlet;

a third valve assembly in the third valve chamber;

the third valve chamber communicating with the first valve outlet and the second valve outlet;

the housing defining a fourth valve chamber;

the fourth valve chamber communicating with the third valve assembly through the third valve outlet;

a fourth valve assembly in the fourth valve chamber; and the fourth valve chamber communicating with a fourth valve outlet defined by the housing.

13. The venting control apparatus as in claim 12, wherein the housing contains the first float valve assembly, the second float valve assembly, the third valve assembly and the fourth valve assembly.

14. The venting control apparatus as in claim 13 in combination with a fuel tank.

15. A venting control system for use with a fuel tank, the venting control system comprising:

a housing;

a fuel vapor discharge valve operatively retained in the housing;

a run-loss valve retained in the housing;

the fuel vapor discharge valve communicating with a fuel tank;

the run-loss valve communicating with at least the fuel vapor discharge valve; and an overlying valve communicating with the fuel vapor discharge valve and the run-loss valve.

16. A venting control system for use with a fuel tank, the venting control system comprising:

a housing;

a fuel vapor discharge valve operatively retained in the housing;

a run-loss valve retained in the housing;

the fuel vapor discharge valve communicating with a fuel tank;

the run-loss valve communicating with at least the fuel vapor discharge valve; and an overlying valve communicating with the fuel vapor discharge valve and the run-loss valve; and a low pressure recirculation system communicating with the overlying valve.

17. The venting control system as in claim 16, the low pressure recirculation system is retained in the housing.

18. A venting control system for use with a fuel tank, the venting control system comprising:

a housing;

a fuel vapor discharge valve operatively retained in the housing;

a run-loss valve retained in the housing;

the fuel vapor discharge valve communicating with a fuel tank;

the run-loss valve communicating with at least the fuel vapor discharge valve; and an overlying valve communicating with the fuel vapor discharge valve and the run-loss valve;

the overlying valve including a float baffle retained in the housing;

the fuel vapor discharge valve having a discharge exit port and a discharge float displaceably positioned proximate to the discharge exit port;

the run-loss valve housing a run-loss exit port and a run-loss float displaceably positioned proximate to the run-loss exit port; and the float baffle being configured for overlying the discharge exit port and the run-loss exit port for preventing escape of liquid fuel from the venting control system.

19. A venting control system in combination with a fuel tank for use with a fuel tank, the venting control system comprising:

a housing;

a fuel vapor discharge valve operatively retained in the housing;

a run-loss valve retained in the housing;

the fuel vapor discharge valve communicating with a fuel tank;

the run-loss valve communicating with at least the fuel vapor discharge valve; and an overlying valve communicating with the fuel vapor discharge valve and the run-loss valve.

20. A venting control system for a fuel tank comprising:

a housing;

a first float valve in the housing for selective communication with a fuel tank;

a second float valve in the housing for selective communication with the first float valve; and means for trapping liquid positioned proximate to and communicating with the first float valve and the second float valve for blocking passage of liquid fuel from the first float valve and the second float valve.

21. A venting control apparatus for use with a fuel tank comprising:

a housing defining a first chamber communicating with the fuel tank a second chamber communicating with the first chamber, and a third chamber communicating with the first and second chambers;

a first float valve retained in the housing for travel in the first chamber;

a second float valve retained in the housing for travel in the second chamber;

the first and second float valves generally oriented in the housing and moving along corresponding generally parallel first and second axes of travel;

a third float valve retained in the third chamber in the housing; and the third float valve operating generally long a third axis of travel generally parallel to said first and second axes of travel.

* * * * *